US010793804B2

(12) United States Patent
Oh

(10) Patent No.: US 10,793,804 B2
(45) Date of Patent: Oct. 6, 2020

(54) AUTOMATIC TRANSMISSION OIL COMPOSITION

(71) Applicants: HYUNDAI MOTOR COMPANY, Seoul (KR); KIA MOTORS CORPORATION, Seoul (KR)

(72) Inventor: Jung Joon Oh, Seongnam-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/255,755

(22) Filed: Jan. 23, 2019

(65) Prior Publication Data

US 2020/0123465 A1 Apr. 23, 2020

(30) Foreign Application Priority Data

Oct. 18, 2018 (KR) ..... 10-2018-0124538

(51) Int. Cl.

| | |
|---|---|
| ***C10M 169/04*** | (2006.01) |
| ***C10M 145/14*** | (2006.01) |
| ***C10M 157/00*** | (2006.01) |
| ***C10M 135/18*** | (2006.01) |
| ***C10M 129/54*** | (2006.01) |
| ***C10M 137/10*** | (2006.01) |
| ***C10M 141/10*** | (2006.01) |
| ***C10M 161/00*** | (2006.01) |
| ***C10M 143/08*** | (2006.01) |
| *C10N 30/02* | (2006.01) |
| *C10N 30/04* | (2006.01) |
| *C10N 30/06* | (2006.01) |
| *C10N 40/04* | (2006.01) |

(52) U.S. Cl.

CPC ..... *C10M 169/044* (2013.01); *C10M 129/54* (2013.01); *C10M 135/18* (2013.01); *C10M 137/10* (2013.01); *C10M 141/10* (2013.01); *C10M 143/08* (2013.01); *C10M 145/14* (2013.01); *C10M 157/00* (2013.01); *C10M 161/00* (2013.01); *C10M 2203/003* (2013.01); *C10M 2205/028* (2013.01); *C10M 2207/144* (2013.01); *C10M 2209/084* (2013.01); *C10M 2219/068* (2013.01); *C10M 2223/045* (2013.01); *C10N 2030/02* (2013.01); *C10N 2030/04* (2013.01); *C10N 2030/06* (2013.01); *C10N 2040/042* (2020.05)

(58) Field of Classification Search

CPC ..... C10M 169/044; C10M 161/00; C10M 157/00; C10M 129/54; C10M 137/10; C10M 143/08; C10M 145/14; C10M 141/10; C10M 135/18; C10M 2223/045; C10M 2207/144; C10M 2209/084; C10M 2219/068; C10M 2203/003; C10M 2205/028; C10N 2230/06; C10N 2230/02; C10N 2240/042; C10N 2230/04

See application file for complete search history.

(56) References Cited

U.S. PATENT DOCUMENTS

| | | | | |
|---|---|---|---|---|
| 2010/0062954 | A1* | 3/2010 | Fujita | C10M 105/04 508/110 |
| 2010/0087349 | A1* | 4/2010 | Lee | C10M 111/04 508/499 |
| 2016/0186086 | A1* | 6/2016 | Loper | C10M 133/44 508/287 |

FOREIGN PATENT DOCUMENTS

KR 10-2011-0059308 A 6/2011

* cited by examiner

*Primary Examiner* — Taiwo Oladapo

(74) *Attorney, Agent, or Firm* — Mintz Levin Cohn Ferris Glovky and Popeo, P.C.; Peter F. Corless

(57) ABSTRACT

An automatic transmission oil composition includes 80 to 85 wt % of a base oil, 1 to 5 wt % of metallocene polyalphaolefin, 1 to 5 wt % of a detergent-dispersant, 0.01 to 0.03 wt % of a trinuclear molybdenum-based dialkyldithiocarbamate friction modifier, 3 to 10 wt % of a viscosity modifier, and 3 to 5 wt % of an anti-wear additive. The automatic transmission oil composition is prepared by mixing base oil with metallocene polyalphaolefin and a trinuclear molybdenum-based dialkyldithiocarbamate friction modifier at specific mixing ratios, whereby the dynamic friction coefficient can be maintained at an equivalent level and the metal friction coefficient can be reduced, thus improving the power transfer efficiency between transmission metals and fuel economy (an improvement of 1.5% or more), increasing durability, and minimizing energy loss.

10 Claims, No Drawings

AUTOMATIC TRANSMISSION OIL COMPOSITION

CROSS-REFERENCE TO RELATED APPLICATION

This application claims, under 35 U.S.C. § 119(a), the benefit of priority to Korean Patent Application No. 10-2018-0124538, filed Oct. 18, 2018, the entire contents of which is incorporated herein for all purposes by reference.

BACKGROUND

1. Technical Field

The present disclosure relates to a lubrication oil composition for use in a vehicle.

2. Description of the Related Art

In recent years, regulations for exhaust gas emitted from vehicles, such as carbon dioxide, etc., have become more stringent in order to encourage the efficient use of energy and to prevent global warming. Because of such environmental regulations, the development of fuel-economy-improving engine and transmission oil that may reduce energy loss of the engine has been actively carried out.

Particularly in transmission oil, improving the friction characteristics when shifting gears may increase power transfer efficiency to thus minimize energy loss. However, in order to improve the friction characteristics, when the metal friction coefficient is decreased, the dynamic friction coefficient is also lowered, and thus the durability of the gears is deteriorated due to a shift slip phenomenon occurring due to clutch friction. Furthermore, the degraded shift quality results in deterioration of fuel economy.

SUMMARY

One aspect of the invention provides a transmission oil composition that is able to decrease the metal friction coefficient and the dynamic friction coefficient to appropriate ranges when applied to an engine and a transmission, thus improving the friction characteristics to thereby increase gear durability and fuel economy.

Another aspect of the present invention provides an automatic transmission oil composition, which is capable of maintaining the dynamic friction coefficient at an equivalent level and maximizing a reduction in the metal friction coefficient to thus improve the power transfer efficiency and fuel economy of a transmission.

Still another aspect of the invention provides a lubrication oil composition, in which the dynamic friction coefficient of an automatic transmission is maintained at an appropriate level and the metal friction coefficient thereof is remarkably decreased to thus improve the power transfer efficiency and fuel economy of a transmission and also increase wear resistance.

Yet another aspect of the present invention provides an automatic transmission oil composition, which is capable of increasing the wear resistance of a transmission and minimizing energy loss.

The aspects of the present invention are not limited to the foregoing, and will be able to be clearly understood through the following description and to be realized by the means described in the claims and combinations thereof. A further aspect of the present invention provides an automatic transmission oil composition, comprising: 80 to 85 wt % of base oil, 1 to 5 wt % of metallocene polyalphaolefin, 1 to 5 wt % of a detergent-dispersant, 0.01 to 0.03 wt % of a trinuclear molybdenum-based dialkyldithiocarbamate friction modifier, 3 to 10 wt % of a viscosity modifier, and 3 to 5 wt % of an antiwear additive.

The base oil may have a kinematic viscosity of 2.8 to 3.2 cSt at 100° C.

The metallocene polyalphaolefin may be configured such that a metallocene compound is copolymerized with an alpha-olefin.

The metallocene compound may be at least one selected from the group consisting of bis(cyclopentadienyl)zirconium dichloride, bis(methylcyclopentadienyl)zirconium dichloride, bis(ethylcyclopentadienyl)zirconium dichloride, bis(iso-propylcyclopentadienyl)zirconium dichloride, bis(n-propylcyclopentadienyl)zirconium dichloride, bis(n-butylcyclopentadienyl)zirconium dichloride, bis(t-butylcyclopentadienyl)zirconium dichloride, bis(decylcyclopentadienyl)zirconium dichloride, bis(trimethylsilylcyclopentadienyl)zirconium dichloride, bis(trimethylsilylmethylcyclopentadienyl)zirconium dichloride, bis(cyclopentadienyl)zirconium chlorohydride, bis(cyclopentadienyl)methyl zirconium chloride and bis(cyclopentadienyl)ethyl zirconium chloride.

The alpha-olefin may be a C6-C12 monomer.

The metallocene polyalphaolefin may have a kinematic viscosity of 150 to 160 cSt at 100° C. and a weight average molecular weight (Mw) of 1000 to 30000 g/mol.

The detergent-dispersant may be calcium salicylate, calcium sulfonate or a mixture thereof.

The trinuclear molybdenum-based dialkyldithiocarbamate friction modifier may be a compound represented by Chemical Formula 2 below.

[Chemical Formula 2]

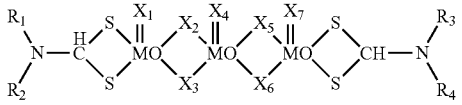

(In Chemical Formula 2, $R_1$ to $R_4$ are the same as or different from each other and are each independently a C1-C24 alkyl group, and $X_1$ to $X_7$ are the same as or different from each other and are each independently sulfur or oxygen.)

The viscosity modifier may be at least one selected from the group consisting of polymethacrylate (PMA), an olefin copolymer, and polyisobutylene.

The antiwear additive may be at least one selected from the group consisting of zinc alkyl dithiophosphate, amine phosphite, and isobutynyl succinic ester.

The automatic transmission oil composition may have a kinematic viscosity of 5.3 to 5.5 cSt at 100° C. and a metal friction coefficient of 0.075 to 0.078 under conditions of a speed of 1 m/s and a temperature of 110° C.

According to embodiments of the present invention, the automatic transmission oil composition is prepared by mixing base oil with metallocene polyalphaolefin and a trinuclear molybdenum-based dialkyldithiocarbamate friction modifier at specific mixing ratios, whereby the dynamic friction coefficient can be maintained at an equivalent level and the metal friction coefficient can be reduced, thus maximizing power transfer efficiency between transmission metals and an improvement in fuel economy (1.5% or more).

Additionally, in the automatic transmission oil composition according to embodiments of the present invention, individual functional groups of the metallocene polyalphaolefin and the trinuclear molybdenum-based dialkyldithiocarbamate friction modifier are adsorbed to the metal surface of the transmission through crosslinking due to van der Waals force, thereby improving the durability of the automatic transmission and also reducing intermetallic resistance, ultimately decreasing the overall friction resistance and minimizing energy loss.

The effects of embodiments of the present invention are not limited to the foregoing, and should be understood to include all reasonably possible effects in the following description.

DESCRIPTION OF EMBODIMENTS

The above and other aspects, features and advantages of the present invention will be more clearly understood from embodiments discussed below. However, the present invention is not limited to the embodiments disclosed herein, and may be modified into different forms. These embodiments are provided to thoroughly explain the invention and to sufficiently transfer the spirit of the present invention to those skilled in the art.

It will be understood that, although terms such as "first", "second", etc. may be used herein to describe various elements, these elements are not to be limited by these terms. These terms are only used to distinguish one element from another element. For instance, a "first" element discussed below could be termed a "second" element without departing from the scope of the present invention. Similarly, the "second" element could also be termed a "first" element. As used herein, the singular forms are intended to include the plural forms as well, unless the context clearly indicates otherwise.

It will be further understood that the terms "comprise", "include", "have", etc., when used in this specification, specify the presence of stated features, integers, steps, operations, elements, components, or combinations thereof, but do not preclude the presence or addition of one or more other features, integers, steps, operations, elements, components, or combinations thereof. Also, it will be understood that when an element such as a layer, film, area, or sheet is referred to as being "on" another element, it can be directly on the other element, or intervening elements may be present therebetween. Similarly, when an element such as a layer, film, area, or sheet is referred to as being "under" another element, it can be directly under the other element, or intervening elements may be present therebetween.

Unless otherwise specified, all numbers, values, and/or representations that express the amounts of components, reaction conditions, polymer compositions, and mixtures used herein are to be taken as approximations including various uncertainties affecting the measurements that essentially occur in obtaining these values, among others, and thus should be understood to be modified by the term "about" in all cases. Furthermore, when a numerical range is disclosed in this specification, the range is continuous, and includes all values from the minimum value of said range to the maximum value thereof, unless otherwise indicated. Moreover, when such a range pertains to integer values, all integers including the minimum value to the maximum value are included, unless otherwise indicated.

In the present disclosure, when a range is described for a variable, it will be understood that the variable includes all values including the end points described within the stated range. For example, the range of "5 to 10" will be understood to include any subranges, such as 6 to 10, 7 to 10, 6 to 9, 7 to 9, and the like, as well as individual values of 5, 6, 7, 8, 9 and 10, and will also be understood to include any value between valid integers within the stated range, such as 5.5, 6.5, 7.5, 5.5 to 8.5, 6.5 to 9, and the like. Also, for example, the range of "10% to 30%" will be understood to include any subranges, such as 10% to 15%, 12% to 18%, 20% to 30%, etc., as well as all integers including values of 10%, 11%, 12%, 13% and the like up to 30%, and will also be understood to include any value between valid integers within the stated range, such as 10.5%, 15.5%, 25.5%, and the like.

As used herein, the term "metal friction coefficient" refers to the coefficient of friction generated by direct contact between a metal and a metal surface. Also, the term "dynamic friction coefficient" refers to the ratio of the force (dynamic frictional force) that opposes the motion of a body in contact with the surface of another to the opposing force normal to the contact surface. Also, "fluid friction resistance" refers to the resistance that is applied to a fluid (lubricant, etc.) that flows.

Embodiments of the present invention pertain to an automatic transmission oil composition or automatic transmission fluid composition, which is prepared by mixing base oil with metallocene polyalphaolefin and a trinuclear molybdenum-based dialkyldithiocarbamate friction modifier at specific mixing ratios, whereby the dynamic friction coefficient can be maintained at an equivalent level and the metal friction coefficient can be reduced, thus maximizing power transfer efficiency between transmission metals and an improvement in fuel economy (1.5% or more).

Furthermore, in the automatic transmission oil composition according to embodiments of the present invention, individual functional groups of the metallocene polyalphaolefin and the trinuclear molybdenum-based dialkyldithiocarbamate friction modifier are adsorbed to the metal surface of the transmission through crosslinking due to van der Waals force, thereby improving the durability of the automatic transmission and also reducing intermetallic resistance, ultimately decreasing overall friction resistance and minimizing energy loss.

More specifically, the automatic transmission oil composition according to embodiments of the present invention may comprise 80 to 85 wt % of base oil, 1 to 5 wt % of metallocene polyalphaolefin (mPAO), 1 to 5 wt % of a detergent-dispersant, 0.01 to 0.03 wt % of a trinuclear molybdenum-based dialkyldithiocarbamate friction modifier, 3 to 10 wt % of a viscosity modifier, and 3 to 5 wt % of an antiwear additive.

In embodiments, in the automatic transmission oil composition, the base oil is present in an amount of 79, 79.5, 80, 80.5, 81, 81.5, 82, 82.5, 83, 83.5, 84, 84.5, 85, 85.5 or 86 wt %. In embodiments, the base oil is present in an amount of a weight % (wt %) that is in a range formed by any two numbers selected from those listed in the proceeding sentence.

In embodiments, in the automatic transmission oil composition, metallocene polyalphaolefin (mPAO) is present in an amount of 0.5, 1, 1.5, 2, 2.5, 3, 3.5, 4, 4.5, 5 or 5.5 wt %. In embodiments, metallocene polyalphaolefin (mPAO) is present in an amount of a weight % (wt %) that is in a range formed by any two numbers selected from those listed in the proceeding sentence.

In embodiments, in the automatic transmission oil composition, the detergent-dispersant is present in an amount of 0.5, 1, 1.5, 2, 2.5, 3, 3.5, 4, 4.5, 5 or 5.5 wt %. In embodiments, the detergent-dispersant is present in an amount of a weight % (wt %) that is in a range formed by any two numbers selected from those listed in the proceeding sentence.

In embodiments, in the automatic transmission oil composition, the trinuclear molybdenum-based dialkyldithiocarbamate friction modifier is present in an amount of 0.01, 0.015, 0.02, 0.025, 0.03 or 0.035 wt %. In embodiments, the trinuclear molybdenum-based dialkyldithiocarbamate friction modifier is present in an amount of a weight % (wt %) that is in a range formed by any two numbers selected from those listed in the proceeding sentence.

In embodiments, in the automatic transmission oil composition, the viscosity modifier is present in an amount of 2.5, 3, 3.5, 4, 4.5, 5, 5.5, 6, 6.5, 7, 7.5, 8, 8.5, 9, 9.5, 10 or 10.5 wt %. In embodiments, the viscosity modifier is present in an amount of a weight % (wt %) that is in a range formed by any two numbers selected from those listed in the proceeding sentence.

In embodiments, in the automatic transmission oil composition, the antiwear additive is present in an amount of 2.5, 3, 3.5, 4, 4.5, 5 or 5.5 wt %. In embodiments, the antiwear additive is present in an amount of a weight % (wt %) that is in a range formed by any two numbers selected from those listed in the proceeding sentence.

In embodiments, the base oil may be base oil corresponding to Group 3 classified in accordance with the criteria of mineral base oil designated by the American Petroleum Institute (API). The base oil may have a kinematic viscosity of 2.8 to 3.2 cSt at 100° C.

The metallocene polyalphaolefin is synthetic base oil that reduces fluid friction resistance, and may be configured such that a metallocene compound is copolymerized with an alpha-olefin through crosslinking.

The metallocene compound may be at least one selected from the group consisting of bis(cyclopentadienyl)zirconium dichloride, bis(methylcyclopentadienyl)zirconium dichloride, bis(ethylcyclopentadienyl)zirconium dichloride, bis(iso-propylcyclopentadienyl)zirconium dichloride, bis(n-propylcyclopentadienyl)zirconium dichloride, bis(n-butylcyclopentadienyl)zirconium dichloride, bis(t-butylcyclopentadienyl)zirconium dichloride, bis(decylcyclopentadienyl)zirconium dichloride, bis(trimethylsilylcyclopentadienyl)zirconium dichloride, bis(trimethylsilylmethylcyclopentadienyl)zirconium dichloride, bis(cyclopentadienyl)zirconium chlorohydride, bis(cyclopentadienyl)methyl zirconium chloride and bis(cyclopentadienyl)ethyl zirconium chloride.

The alpha-olefin may be a C6-C12 monomer. The alpha-olefin is able to reduce the friction resistance of the metal surface of the transmission, together with the functional group of the friction modifier.

In embodiments, the metallocene polyalphaolefin is a compound represented by Chemical Formula 1 below. The metallocene polyalphaolefin functions to smooth fluid flow to thus reduce fluid resistance by adsorbing a hydrocarbon molecule, which is a functional group in Chemical Formula 1, to the metal surface of the transmission.

[Chemical Formula 1]

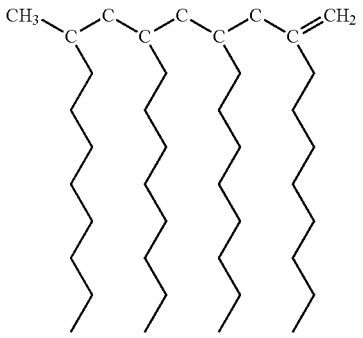

The metallocene polyalphaolefin may have a kinematic viscosity of 150 to 160 cSt at 100° C. and a weight average molecular weight (Mw) of 1000 to 30000 g/mol. When the kinematic viscosity of the metallocene polyalphaolefin is equal to or more than 150 cSt, it plays a sufficient role in reducing the metal friction resistance. When the kinematic viscosity thereof is equal to or less than 160 cSt, it is possible to avoid or minimize increase of the oil viscosity and further avoid or minimize undesirably degrading fuel economy. In one embodiment, the metallocene polyalphaolefin has a kinematic viscosity of 154 to 158 cSt at 100° C. and a weight average molecular weight (Mw) of 15000 to 20000 g/mol.

The metallocene polyalphaolefin may be contained in an amount of 1 to 5 wt % based on the total amount of the automatic transmission oil composition. Here, when the amount thereof is equal to or greater than 1 wt %, it is possible to maximize the effect of reducing the metal friction coefficient. When the amount thereof is equal to or less than 5 wt %, it is possible to avoid or minimize increase of fluid friction resistance, and to maximize an improvement in fuel economy. In one embodiment, in order to effectively reduce fluid friction resistance, the amount of metallocene polyalphaolefin falls in the range of 2 to 4 wt %.

The detergent-dispersant enables deposits such as oxides or sludge formed by oxidation of the automatic transmission oil composition in the engine and transmission to be dispersed in the form of fine particles to float, whereby the clutch may be kept clean. The detergent-dispersant may be calcium salicylate, calcium sulfonate or a mixture thereof.

The detergent-dispersant may be contained in an amount of 1 to 5 wt % based on the total amount of the automatic transmission oil composition. When the amount thereof is equal to or more than 1 wt %, it is possible to maximize the dispersion effect, and thus the clutch can be kept clean. When the amount thereof is equal to or less than 5 wt %, it is possible to avoid or minimize increase of intermolecular resistance and to further avoid or minimize deterioration of clutch friction performance. In one embodiment, the amount of the detergent-dispersant falls in the range of 3 to 5 wt %.

The friction modifier functions to impart the automatic transmission oil composition with properties of reducing the metal friction coefficient while maintaining the clutch dynamic friction coefficient at an equivalent level, thus increasing the power transfer efficiency of the transmission. The friction modifier may be trinuclear molybdenum-based dialkyldithiocarbamate, as represented by Chemical Formula 2 below. In particular, the sulfur compound, which is a functional group in Chemical Formula 2, may be adsorbed to the metal surface of the transmission by Van der Waals force, together with the metallocene polyalphaolefin, thus decreasing friction resistance between metal materials and increasing wear resistance.

[Chemical Formula 2]

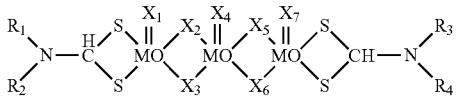

(In Chemical Formula 2, $R_1$ to $R_4$ are the same as or different from each other and are each independently a C1-C24 alkyl group, and $X_1$ to $X_7$ are the same as or different from each other and are each independently sulfur or oxygen.)

The friction modifier may be contained in an amount of 0.01 to 0.03 wt % based on the total amount of the automatic transmission oil composition. When the amount thereof is equal to or more than 0.01 wt %, it is possible to maximize the effect of reducing the metal friction coefficient. When the amount thereof is equal to or less than 0.03 wt %, it is possible to avoid or minimize decrease of the dynamic friction coefficient, and to minimize deterioration of durability. In one embodiment, the amount of the friction modifier is set to 0.02 wt %.

The viscosity modifier functions to decrease the high viscosity of the composition when the automatic transmission oil composition is at a low temperature so that the clutch may operate smoothly, and also functions to increase the low viscosity of the composition when the automatic transmission oil composition is at a high temperature, thereby preventing intermetallic friction and wear from occurring. The viscosity modifier may be at least one selected from the group consisting of polymethacrylate (PMA), an olefin copolymer, and polyisobutylene.

The viscosity modifier may be contained in an amount of 3 to 10 wt % based on the total amount of the automatic transmission oil composition. When the amount thereof is equal to or more than 3 wt %, it is possible to maximize the effect of increasing the viscosity, and to minimize the deterioration of durability. When the amount thereof is equal to or less than 10 wt %, it is possible to inhibit low-temperature viscosity from being excessively high and to minimize deterioration of low-temperature operability. In one embodiment, the amount of the viscosity modifier falls in the range of 8 to 10 wt %.

The antiwear additive functions to protect against wear by forming a protective film on the friction metal surface of a friction material, a metal plate, etc. The antiwear additive may be at least one selected from the group consisting of zinc alkyl dithiophosphate, amine phosphite, and isobutynyl succinic ester.

As described above, the automatic transmission oil composition of embodiments of the present invention may have a kinematic viscosity of 5.3 to 5.5 cSt at 100° C. and a metal friction coefficient of 0.075 to 0.078 under conditions of a speed of 1 m/s and a temperature of 110° C. Furthermore, the automatic transmission oil composition may have a dynamic friction coefficient of 0.122 to 0.125 under conditions of 3600 rpm, 230 kPa and 120° C. When all of the conditions pertaining to the metal friction coefficient and the dynamic friction coefficient are satisfied, the power transfer efficiency and fuel economy of the transmission may be maximized.

A better understanding of embodiments of the present invention will be given through the following examples, which are merely set forth to illustrate but are not to be construed as limiting the scope of the present invention.

Examples 1 to 7 and Comparative Examples 1 to 7

Respective automatic transmission oil compositions were prepared through a typical process using the components in the amounts shown in Tables 1 and 2 below.

TABLE 1

| | Example | | | | | | |
|---|---|---|---|---|---|---|---|
| Component (wt %) | 1 | 2 | 3 | 4 | 5 | 6 | 7 |
| Base oil[1)] | 86.48 | 85.48 | 84.48 | 83.48 | 82.48 | 84.49 | 84.47 |
| Metallocene polyalphaolefin[2)] | 1 | 2 | 3 | 4 | 5 | 3 | 3 |
| Detergent-dispersant[3)] | 1.5 | 1.5 | 1.5 | 1.5 | 1.5 | 1.5 | 1.5 |
| Friction modifier[4)] | 0.02 | 0.02 | 0.02 | 0.02 | 0.02 | 0.01 | 0.03 |
| Viscosity modifier[5)] | 8 | 8 | 8 | 8 | 8 | 8 | 8 |
| Antiwear additive[6)] | 3 | 3 | 3 | 3 | 3 | 3 | 3 |

[1)]Base oil: Grll, Yubase-3, 100° C. kinematic viscosity 3.2 cSt, made by SK

[2)]Metallocene polyalphaolefin: 100° C. kinematic viscosity 156 cSt, molecular average molecular weight (Mw) 15000-20000 g/mol, made by ExxonMobil

[3)]Detergent-dispersant: Calcium salicylate

[4)]Friction modifier: Moly Trimer (trinuclear molybdenum dialkyldithiocarbamate), made by Infineum

[5)]Viscosity modifier: Polymethacrylate

[6)]Antiwear additive: Zinc alkyl dithiophosphate, made by Lubrizol

TABLE 2

| | Comparative Example | | | | | | |
|---|---|---|---|---|---|---|---|
| Component (wt %) | 1 (Current specification) | 2 | 3 | 4 | 5 | 6 | 7 |
| Base oil[1)] | 87.5 | 87.48 | 86.98 | 81.98 | 84.5 | 84.495 | 84.46 |
| Metallocene polyalphaolefin[2)] | — | — | 0.5 | 5.5 | 3 | 3 | 3 |
| Detergent-dispersant[3)] | 1.5 | 1.5 | 1.5 | 1.5 | 1.5 | 1.5 | 1.5 |
| Friction modifier[4)] | — | 0.02 | 0.02 | 0.02 | — | 0.005 | 0.04 |
| Viscosity modifier[5)] | 8 | 8 | 8 | 8 | 8 | 8 | 8 |
| Antiwear additive[6)] | 3 | 3 | 3 | 3 | 3 | 3 | 3 |

[1)]Base oil: Grll, Yubase-3, 100° C. kinematic viscosity 3.2 cSt, made by SK

[2)]Metallocene polyalphaolefin: 100° C. kinematic viscosity 156 cSt, molecular average molecular weight (Mw) 15000-20000 g/mol, made by ExxonMobil

[3)]Detergent-dispersant: Calcium salicylate

[4)]Friction modifier: Moly Trimer (trinuclear molybdenum dialkyldithiocarbamate), made by Infineum

[5)]Viscosity modifier: Polymethacrylate

[6)]Antiwear additive: Zinc alkyl dithiophosphate, made by Lubrizol

Test Example

The properties of the automatic transmission compositions of Examples 1 to 7 and Comparative Examples 1 to 7 were measured through the following methods. The results are shown in Tables 3 and 4 below.

(1) Metal friction coefficient: Metal friction between a metal friction material and a metal material for a steel plate was measured at 1 m/s×110° C. using a block-on-ring test machine.

(2) Dynamic friction coefficient: Dynamic friction between a paper friction material and a steel plate was measured at 3600 rpm×230 kPa×120° C.

(3) Fuel economy improvement (%): Fuel economy was measured in an FTP 75 mode for vehicle fuel economy using a chassis dynamometer. The above fuel economy measurement method is the same as CVS 75, which is a fuel economy test mode in Korea.

(4) Fe wear content after durability test (ppm): Engine 300 to 2000 N torque was rated for 700 hr while shifting through all gears from $1^{st}$ gear to $6^{th}$ gear at an engine speed of 260 to 1600 rpm.

TABLE 3

| Evaluation item | Testing method | Example 1 | 2 | 3 | 4 | 5 | 6 | 7 |
|---|---|---|---|---|---|---|---|---|
| Metal friction coefficient | JASOM358 | 0.078 | 0.077 | 0.075 | 0.076 | 0.076 | 0.077 | 0.076 |
| Dynamic friction coefficient | JASOM348 | 0.123 | 0.124 | 0.125 | 0.123 | 0.123 | 0.124 | 0.122 |
| Fuel economy improvement (%) | Vehicle fuel economy (FTP) | 0.7 | 1.1 | 1.5 | 1.3 | 1.0 | 0.9 | 1.1 |
| Fe wear content after durability test (ppm) | — | 160 | 155 | 130 | 156 | 158 | 135 | 137 |

TABLE 4

| Evaluation item | Testing method | Comparative Example 1 (Current specification) | 2 | 3 | 4 | 5 | 6 | 7 |
|---|---|---|---|---|---|---|---|---|
| Metal friction coefficient | JASOM358 | 0.117 | 0.085 | 0.86 | 0.088 | 0.115 | 0.110 | 0.075 |
| Dynamic friction coefficient | JASOM348 | 0.125 | 0.123 | 0.123 | 0.123 | 0.124 | 0.125 | 0.115 |
| Fuel economy improvement (%) | Vehicle Fuel economy (FTP) | — (criterion) | 0.1 | 0.1 | 0.2 | 0 | 0 | 0 |
| Fe wear content after durability test (ppm) | — | 180 | 185 | 180 | 168 | 165 | 160 | 250 |

As is apparent from the results of Tables 3 and 4, the dynamic friction coefficient was maintained at the equivalent level and the metal friction coefficient was remarkably decreased in Examples 1 to 7 compared to Comparative Examples 1 to 7. Furthermore, by virtue of the reduction in the metal friction coefficient, fuel economy was improved and wear resistance was increased. In Examples 2 to 4 and 7, the fuel economy improvement and wear reduction after the durability test were significantly increased compared to Comparative Example 1 of the current specification. In particular, Example 3 exhibited outstanding values.

In contrast, in Comparative Examples 1, 2 and 5, in which either or both of the metallocene polyalphaolefin and the friction modifier were not added, the effect of reducing the metal friction coefficient was insignificant, or fuel economy and wear resistance were remarkably deteriorated.

In Comparative Example 3, in which the amount of the metallocene polyalphaolefin was low, the fuel economy improvement was poor due to the low friction reduction effect. On the other hand, in Comparative Example 4, in which the amount of the metallocene polyalphaolefin was excessively high, the fluid friction increased due to intermolecular interactions, and thus fuel economy and wear resistance were deteriorated.

In Comparative Example 6, in which the friction modifier was contained in a very small amount, the effect of reducing the metal friction coefficient was insignificant, like Comparative Example 5, and thus fuel economy and wear resistance were deteriorated.

In Comparative Example 7, in which the amount of the friction modifier was high, the metal friction coefficient was as low as in Examples 1 to 7 but the dynamic friction coefficient was decreased, and thus fuel economy improvement and wear resistance were remarkably deteriorated.

Although embodiments of the present invention have been described, those skilled in the art will appreciate that the present invention may be embodied in other specific forms without changing the technical spirit or essential features thereof. Thus, the embodiments described above should be understood to be non-limiting and illustrative in every way.

What is claimed is:

1. An automatic transmission oil composition, comprising:

80 to 85 wt % of a base oil;

1 to 5 wt % of metallocene polyalphaolefin;

1 to 5 wt % of a detergent-dispersant;

0.01 to 0.03 wt % of a trinuclear molybdenum-based dialkyldithiocarbamate friction modifier;

3 to 10 wt % of a viscosity modifier; and 3 to 5 wt % of an antiwear additive, wherein the trinuclear molybdenum-based dialkyldithiocarbamate friction modifier comprises a compound represented by Chemical Formula 2 below,

[Chemical Formula 2]

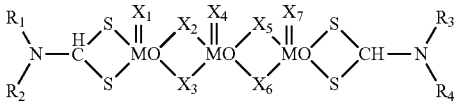

(In Chemical Formula 2, $R_1$ to $R_4$ are the same as or different from each other and are each independently as C1-C24 alkyl group, and $X_1$ to $X_2$ are the same as or different from each other and are each independently sulfur or oxygen).

2. The automatic transmission oil composition of claim 1, wherein the base oil has a kinematic viscosity of 2.8 to 3.2 cSt at 100° C.

3. The automatic transmission oil composition of claim 1, wherein the metallocene polyalphaolefin is configured such that a metallocene compound is copolymerized with an alpha-olefin.

4. The automatic transmission oil composition of claim 3, wherein the metallocene compound comprises at least one selected from the group consisting of bis(cyclopentadienyl) zirconium dichloride, bis(methylcyclopentadienyl)zirconium dichloride, bis(ethylcyclopentadienyl)zirconium dichloride, bis(iso-propylcyclopentadienyl)zirconium dichloride, bis(n-propylcyclopentadienyl)zirconium dichloride, bis(n-butylcyclopentadienyl)zirconium dichloride, bis(t-butylcyclopentadienyl)zirconium dichloride, bis(decylcyclopentadienyl)zirconium dichloride, bis(trimethylsilylcyclopentadienyl)zirconium dichloride, bis(trimethylsilylmethylcyclopentadienyl)zirconium dichloride, bis(cyclopentadienyl)zirconium chlorohydride, bis(cyclopentadienyl) methyl zirconium chloride, and bis(cyclopentadienyl)ethyl zirconium chloride.

5. The automatic transmission oil composition of claim 3, wherein the alpha-olefin comprises a C6-C12 monomer.

6. The automatic transmission oil composition of claim 1, wherein the metallocene polyalphaolefin has a kinematic viscosity of 150 to 160 cSt at 100° C. and a weight average molecular weight (Mw) of 1000 to 30000 g/mol.

7. The automatic transmission oil composition of claim 1, wherein the detergent-dispersant comprises calcium salicylate, calcium sulfonate or a mixture thereof.

8. The automatic transmission oil composition of claim 1, wherein the viscosity modifier comprises at least one selected from the group consisting of polymethacrylate (PMA), an olefin copolymer, and polyisobutylene.

9. The automatic transmission oil composition of claim 1, wherein the antiwear additive comprises at least one selected from the group consisting of zinc alkyl dithiophosphate, amine phosphite, and isobutynyl succinic ester.

10. The automatic transmission oil composition of claim 1, wherein the automatic transmission oil composition has a kinematic viscosity of 5.3 to 5.5 cSt at 100° C. and a metal friction coefficient of 0.075 to 0.078 under conditions of a speed of 1 m/s and a temperature of 110° C.

* * * * *